US006974293B2

(12) United States Patent
Stokes

(10) Patent No.: US 6,974,293 B2
(45) Date of Patent: Dec. 13, 2005

(54) MATERIAL HANDLING ASSEMBLY

(76) Inventor: Van Stokes, 102 Island Ave., Little Falls, NJ (US) 07426

( * ) Notice: Subject to any disclaimer, the term of this patent is extended or adjusted under 35 U.S.C. 154(b) by 475 days.

(21) Appl. No.: 10/177,981

(22) Filed: Jun. 21, 2002

(65) Prior Publication Data

US 2003/0002963 A1 Jan. 2, 2003

Related U.S. Application Data

(60) Provisional application No. 60/300,490, filed on Jun. 25, 2001.

(51) Int. Cl.[7] ..... E04H 6/00

(52) U.S. Cl. ..... 414/236; 414/227; 414/233; 414/237; 414/260

(58) Field of Search ..... 414/227, 233–236, 414/237–240, 253, 257, 260–262, 228, 264, 414/266, 278

(56) References Cited

U.S. PATENT DOCUMENTS 2,837,224 A * 6/1958 Roser ..... 414/236
5,118,239 A * 6/1992 Morioka ..... 414/236
5,190,427 A * 3/1993 Lai ..... 414/278
5,314,285 A * 5/1994 Lai ..... 414/236
5,556,246 A * 9/1996 Broshi ..... 414/278
5,961,270 A * 10/1999 Ortega et al. ..... 414/239

* cited by examiner

*Primary Examiner*—Khoi H. Tran
(74) *Attorney, Agent, or Firm*—Clifford G. Frayne

(57) ABSTRACT

A vertical lift system for storage and in particular for parking motor vehicles comprising a multi-level frame comprising a structure extending upward from a base, and a lifting mechanism centrally positioned within the frame and in communication with each level, and a plurality of platforms positioned on each level about the lift mechanism the plurality of platforms for the receipt of a vehicle. The lift mechanism has capability to retrieve a selected vacant platform and transport it to an entrance/exit level, which can be located at any level within the structure, for positioning of a vehicle thereon, and subsequent transportation to its position on the frame. The lift mechanism provides for shifting the platform and the vehicle thereon either forwardly or rearwardly on the structure into a parking space, laterally to either side into a parking space, and either a forward and lateral or rearward and lateral movement into a parking space thereby providing eight parking spaces surrounding the lift mechanism on each level for vehicles.

4 Claims, 5 Drawing Sheets

MATERIAL HANDLING ASSEMBLY

RELATED APPLICATIONS

Applicant claims the benefit of provisional application Ser. No. 60/300,490 filed Jun. 25, 2001.

BACKGROUND OF THE INVENTION

1. Field of the Invention

The present invention relates to a material handling system and in particular to a vertical lift system particularly adaptable for parking motor vehicles in a vertical configuration on limited area.

2. Description of the Prior Art

Single level and multi-level parking systems for automobiles, trucks, etc., have been used for many years. Single level parking is not cost effective, especially in urban areas. Multi-story parking buildings are utilized but are expensive to construct. Vertical lift systems have been employed, but the known systems are either too complex or too expensive. U.S. Pat. Nos. 2,579,688; 3,387,722; 3,706,356; 3,750,899; and 4,209,276 disclose different types of vertical lift systems. Applicant is also the co-holder of U.S. Pat. No. 4,674,938 for a vertical parking system.

The difficulty with vertical lift systems heretofore was that the vehicle could be lifted to a certain level, but then the vehicle was limited in its movement to a parking space by the mechanicals of the system. The vehicles could be stacked one above the other or the vehicle could be moved off of the vertical lift either forwardly or rearwardly to a parking space or laterally to either side. Therefore while the vehicle vertical lift system could park more vehicles within a foot print of land by parking the vehicles vertically, the systems could not take advance of the entire foot print of land by parking cars in the four corners of the foot print of land. Thus the vertical lift systems could not take advantage of all the vertical space provided.

Still further, in urban areas, the zoning laws oftentimes prescribe spacing required for ingress and egress into parking garages and the size of parking spaces. The present system is adaptable to design compliance with the myriad of zoning laws that are present in various urban areas.

SUMMARY OF THE INVENTION

A vertical lift system for transport and storage and in particular for parking motor vehicles comprising a multi-level frame comprising structural means extending upward from a base, and a lifting means centrally positioned within the frame and in communication with each level, and a plurality of platforms positioned on each level about the lifting means, the plurality of platforms for the receipt of a vehicle. The lifting means has capability to retrieve a selected vacant platform and transport it to an entrance/exit level, which can be located at any level within the structure, for positioning of a vehicle thereon, and subsequent transportation to its position on the frame. The lifting means provides means for shifting the platform and the vehicle thereon either forwardly or rearwardly on the structural means into a parking space, laterally to either side into a parking space, and either a forward and lateral or rearward and lateral movement into a parking space thereby providing eight parking spaces surrounding the lifting means on each level for vehicles.

OBJECTS OF THE INVENTION

An object of the present invention is to provide a simple and cost effective vertical lift system for material handling and storage including parking motor vehicles at different levels.

Another object of the present invention is to provide a novel and cost effective vertical lift system which allows for parking eight vehicles on each level of the structure.

A further object of the present invention is to provide for a novel, cost effective vertical lift system which allows vehicles on the vertical lift to be parked either forwardly or rearwardly, laterally or forwardly laterally, or rearwardly laterally, thus providing eight parking spaces per level.

A further object of the present invention is to provide for a novel vertical lift system for parking motor vehicles in which all movement to a parking space is activated from the vertical lift.

A further object of the present invention is to provide for a novel vertical lift system for parking motor vehicles which conserves energy by using storage devices, accumulators, on the vertical lift system which will allow for much faster operation than is possible with just the energy provided by the small power source contained on the vertical lift system itself.

A further object of the present invention is to provide for a novel vertical lift system for parking motor vehicles in which all movement to a parking space is activated from the vertical lift which stores enough energy, in accumulators, so that all movements on any level can be completed even if the main power to the unit is lost.

A still further object of the present invention is to provide for a novel, cost effective vertical lift system which can incorporate two vertical lifts to operate independently of each other in the same frame.

A still further object of the present invention is to provide for a novel, cost effective vertical lift system which can incorporate an empty platform retrieval system incorporated in the vertical lift system to operate independently of the vertical lift system used for parking vehicles thereby allowing a platform with a vehicle thereupon and an empty platform to be positioned thereon at the same time.

BRIEF DESCRIPTION OF THE DRAWINGS

These and other objects of the present invention will become apparent, particularly when taken in view of the following drawings wherein.

DETAILED DESCRIPTION OF THE DRAWINGS

Figure 1:
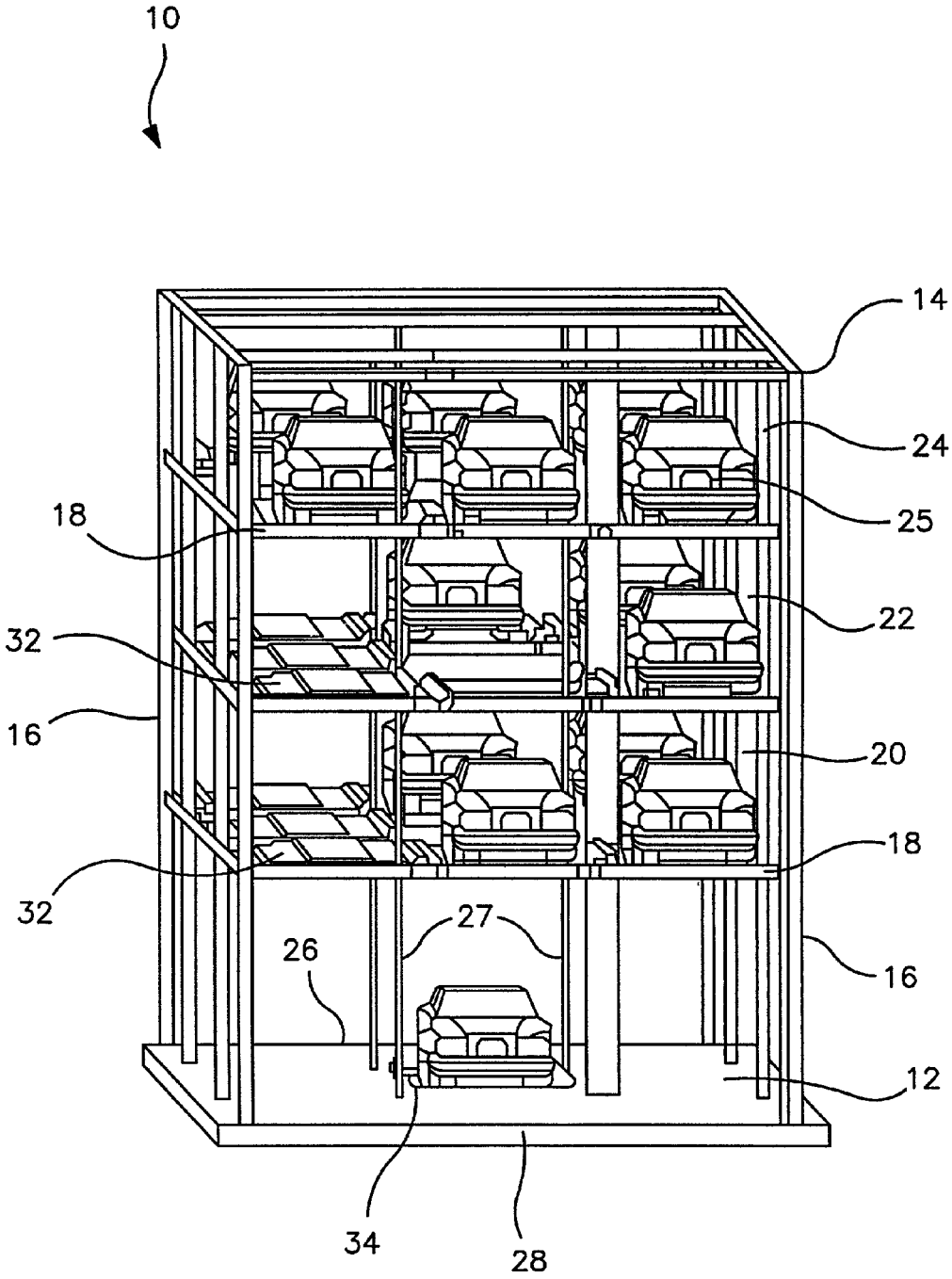
FIG. 1 is a perspective view of a vertical lift parking facility of the present invention.
Figure 2:
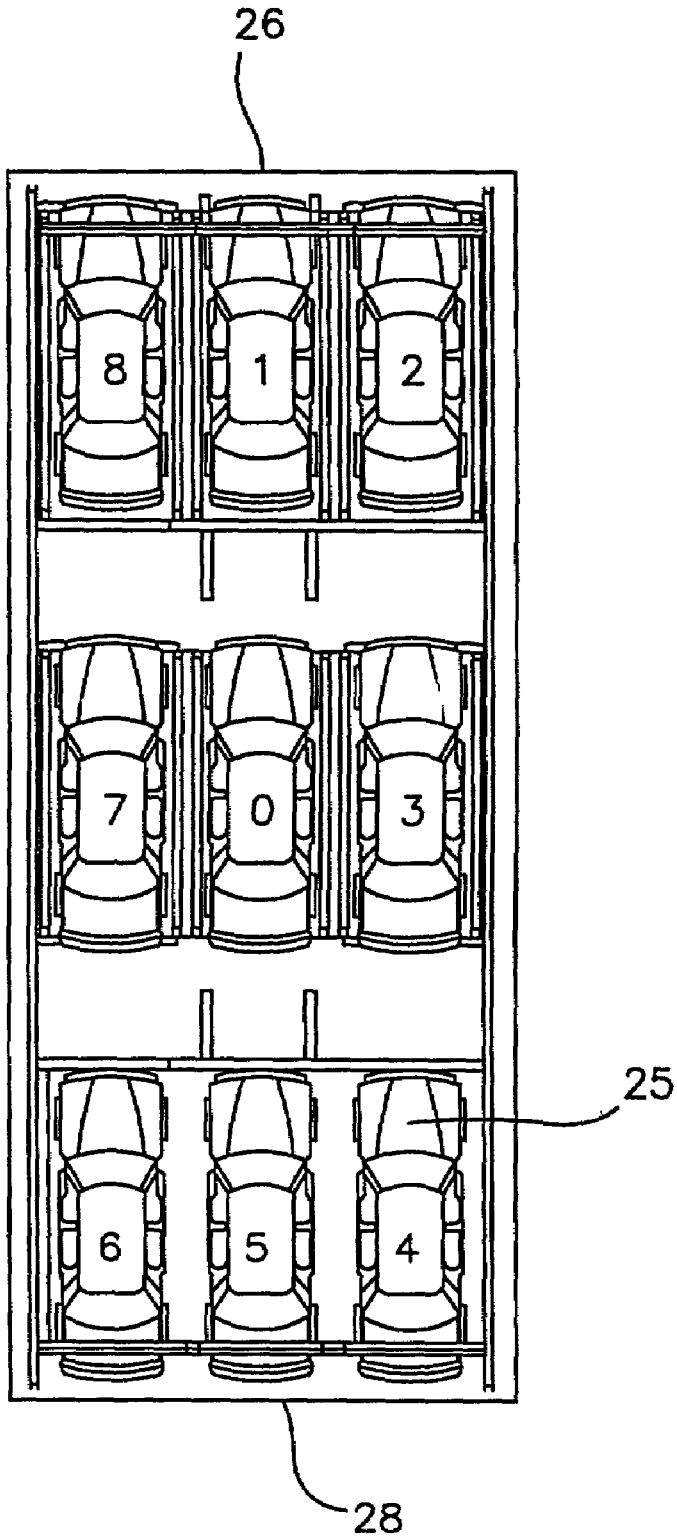
FIG. 2 is a top plan view of one level of a multi-level, vertical lift parking facility of the present invention.
Figure 3:
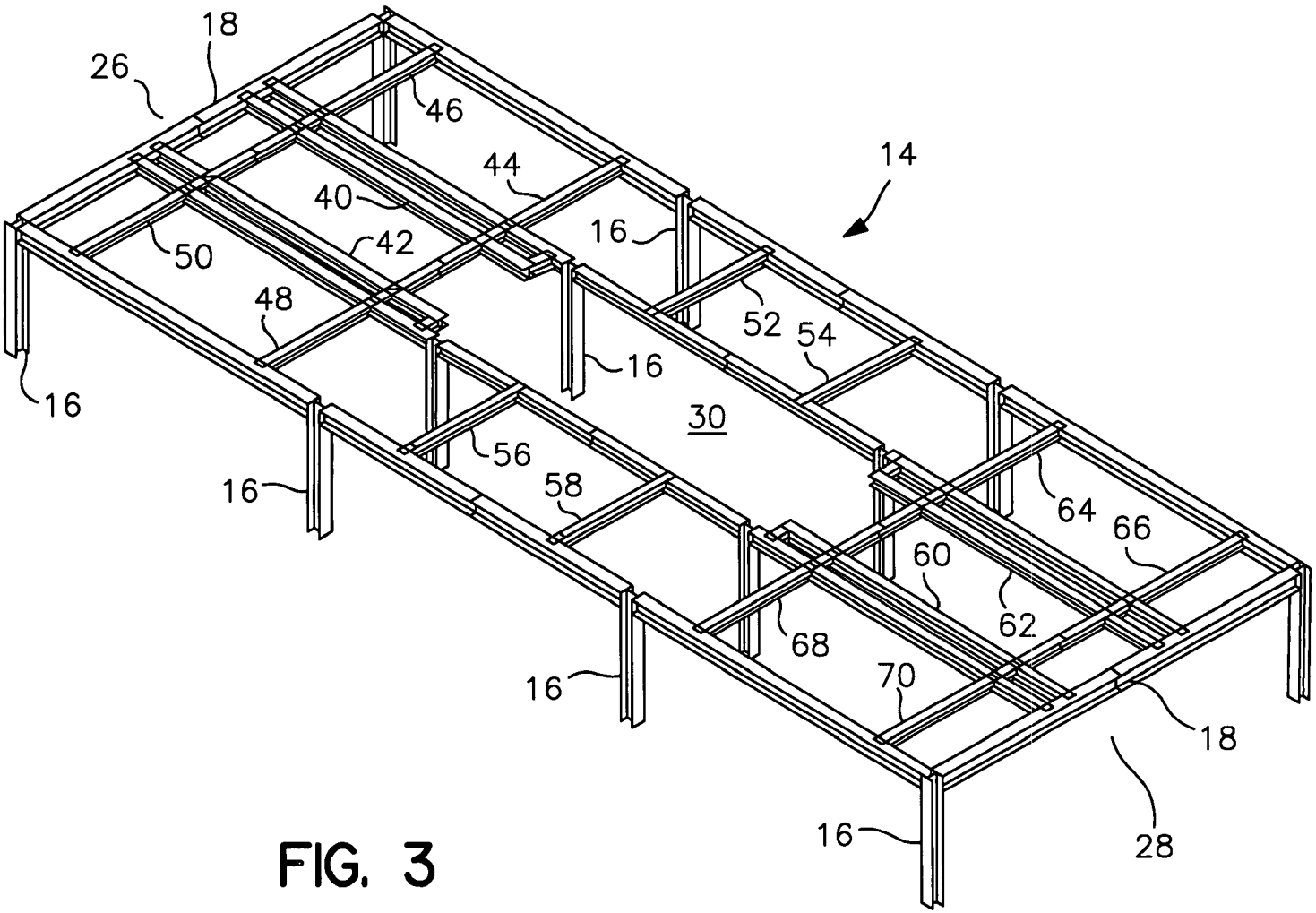
FIG. 3 is a perspective view of one level of the frame of a multi-level parking facility of the present invention.

FIG. 1 is a perspective view of a vertical lift parking facility designated generally 10. FIG. 2 is a top view of one level and FIG. 3 is a perspective view of one level of the frame. In this particular perspective view, the parking facility illustrates three levels of elevated parking as will be discussed in detail hereafter. The vertical lift parking facility consists of a ground foot print 12 upon which a structural frame 14 is constructed. The constructual frame 14 consists of a plurality of vertical support members 16 and horizontal support members 18 such that levels 20, 22, and 24 are formed to support vehicles 25.

The ingress and/or egress level 12, is shown in this diagram at the ground level but can be positioned at any level desired. The ingress is from a first end 26 and the egress from a second end 28. However, it can be reconfigured to allow the ingress and/or egress to be positioned at any parking space on any level. Centrally disposed in the frame 14 is a transporter elevator shaft 30 (FIG. 3) in communication with each of the levels 20, 22, or 24. While the present invention has been disclosed in FIG. 1 with respect to three levels, it will be recognized by one of ordinary skill in the art that more levels are available either above or below the ground level dependent upon the materials used in the frame 14. As can be seen in FIG. 2, each level is divided into nine positions labeled 0 through 8, 0 being the transporter elevator shaft 30.

Heretofore, vehicles could be moved on multi-level, vertical lift parking facilities as disclosed, but the vehicles could only be moved from the transporter elevator shaft 30 either forward or backward or laterally for parking. Thus the parking positions 2, 4, 6, and 8 could not be utilized and the structure itself was under utilized because of the inability to move vehicles to these locations. Applicant's novel contribution in the present invention is for a transporter elevator system which allows vehicles to be maneuvered at each level, from the transporter elevator shaft 30, position 0, to one of these corner parking units, thereby fully utilizing the foot print of the vertical lift parking facility on the ground upon which it is constructed.

FIG. 3 presents a perspective view of one level of the parking facility frame. In operation, a vehicle would be driven into the ingress 26 of the parking facility and positioned on a movable parking platform 32, which would be positioned on a transporter 34 in elevator shaft 30, in communication with an elevator lift mechanism 27 of the type described in U.S. Pat. No. 4,674,938, which is incorporated herein by reference and is operational within the transporter elevator shaft 30. Once a parking platform 32 is positioned on the transporter 34, the elevator lift mechanism would lift the transporter 34 and parking platform 32 and vehicle 25 to the desired level. The transporter 34 incorporates all of the necessary transport equipment to move the vehicle 25 and the parking platform 32 to one of the locations 1 through 8 on any one of the levels 20, 22, 24 of the parking facility 10.

In FIG. 3 it will be noted that each level 20, 22, and 24 of the vertical lift parking facility 10 has a plurality of cross members positioned about transporter elevator shaft 30. These cross members support and guide parking platforms 32 and the vehicles 25 associated therewith as will be described more fully hereafter. For identification purposes with respect to FIG. 3, if we assume that a transporter 34 was positioned at this level of the vehicle parking facility 10 with a parking platform 32 and vehicle 25, the transport mechanism could move platform 32 and vehicle 25 to position 1 by sliding the platform 32 on support members 40 and 42. The transport mechanism could then move the platform 32 and vehicle 25 to either position 2 or 8 by sliding the platform along support members 44 and 46 or 48 and 50 respectively. Platform 32 and vehicle 25 could be transported laterally from transporter 34 by sliding on support members 52 and 54 with respect to position 3 or 56 and 58 with respect to position 7.

The parking platform 32 and vehicle 25 could be moved rearwardly to position 5 on support members 60 and 62 and could thence be moved laterally into positions 4 and 6 by support members 64, 66 and 68, 70. The retrieval of the parking platform 32 and vehicle 25 would be accomplished in the reverse process with respect to the respective parking positions.

Figure 4:
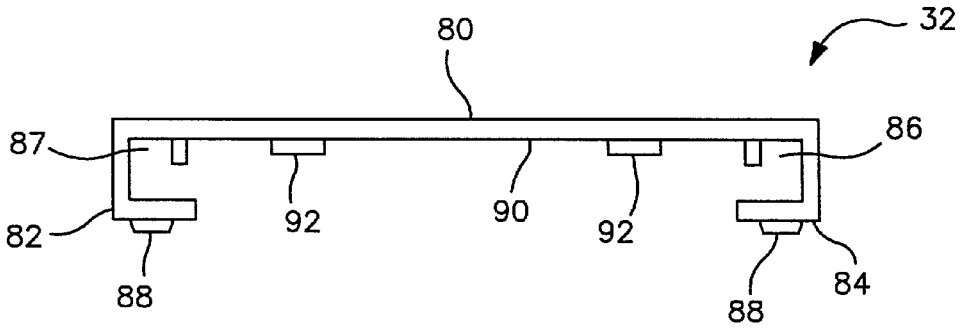
FIG. 4 is an end view of a parking platform of the present invention.
Figure 5:
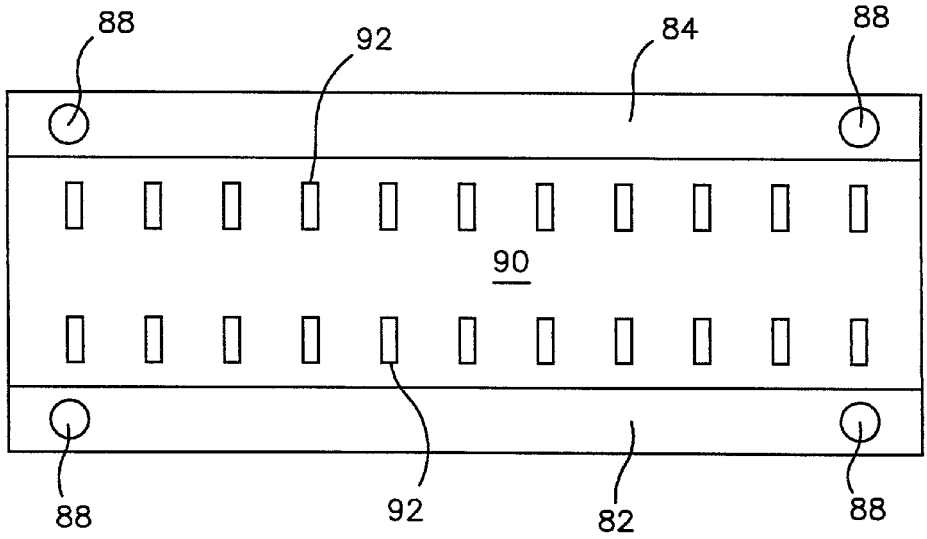
FIG. 5 is a bottom view of a parking platform of the present invention.

FIG. 4 is an end view and FIG. 5 is a bottom view of parking platform 32. Parking platform 32 is constructed of suitable gauge steel and dimensioned such that a vehicle can be driven upon it. Parking platform 32 has an upper surface 80 upon which vehicle 25 is positioned, depending flanges 82 and 84 along the longitudinal sides of parking platform 32 defining channels 86 and 87 extending along the longitudinal sides of platform 32. Depending flanges 82 and 84 have positioned thereon a plurality of plastic sliders 88 which sliders contact the various cross members at each level heretofore discussed and which allows the transporter means described hereafter to slide the parking platform 32 and vehicle 25 along the paths of those various cross members.

The positioning of the plastic sliders 88 on the underside of parking platform 32 is such that if parking platform 32 and vehicle 25 are slid forwardly into position 1, the four plastic sliders 88 would be positioned at the intersection of support members 40, 46; 40, 44; 42, 48; and 42, 50. This positioning thus facilitates the transport of parking platform 32 and vehicle 25 to either position 2 or 8 on support members 44, 46, and 48, 50 respectively, as will be more fully described hereafter. The same holds forth for the opposing end of each level 20, 22, and 24 of vertical lift parking facility 10. There is also formed on the underside surface 90 of platform 32 a plurality of spaced apart forward/rearward engagement members 92 in parallel alignment for the length of platform 32. These engagement members 92 cooperate in the movement of platform 32 and vehicle 25 either forwardly to position 1 or rearwardly to position 5.

Figure 6:
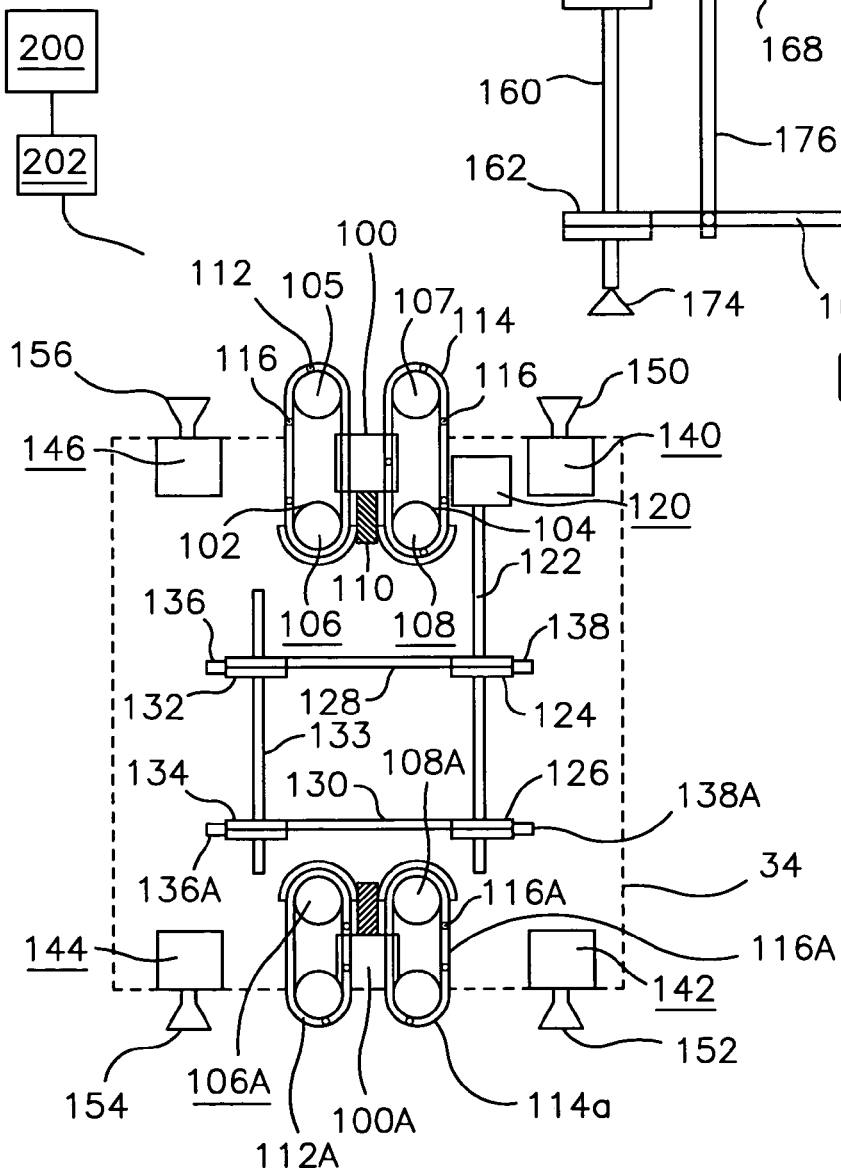
FIG. 6 is a schematic view of the transport mechanicals located on the frame structure and underside of the transport means.

The transporter operation is best understood with respect to FIG. 6, which is a schematic diagram of the mechanicals associated with the frame 14 and transporter 34 in order to move a parking platform and vehicle or parking platform alone to one of the parking positions designated 1 through 8.

Transporter 34 has positioned thereon all of the necessary mechanicals in order to slidably move a parking platform 32 or parking platform 32 and vehicle 25 into the parking positions 1, 3, 5, and 7. Additional mechanicals are mounted in parking positions 1 and 5 to enable a parking platform 32 or parking platform 32 and vehicle 25 to be positioned into the corner positions 2, 4, 6, and 8.

On one end of transporter 34, there is mounted a first hydraulic motor 100 in communication with a pair of drive gears 102 and 104 and drive sprockets 106 and 108 by means of a worm gear 110 or equivalent, gears 102 and 104 being mounted beneath drive sprockets 106 and 108, the drive sprockets 106 and 108 driving two separate chain drives 112 and 114 in counter-rotation with idler sprockets 105 and 107, the chain drives 112 and 114 having a plurality of upstanding fingers 116 which are cooperable with the forward/rearward engagement members 92 on the underside 90 of the parking platform 32. The upstanding fingers 116 on the counter-rotational chain drive 112 and 114 sequentially engage the engagement members 92 to either slide the parking platform 32 or the parking platform 32 and vehicle 25 forwardly into parking position 1 or to engage and slidably remove the parking platform 32 or parking platform 32 and vehicle 25 from parking position 1 to the transporter 34.

An identical arrangement of hydraulic motor 100A, sprockets 106A and 108A, chain drives 112A and 114A and upstanding fingers 116A on the chain drives is found at the opposing end of the transporter for movement of a parking platform 32 or parking platform 32 and vehicle 25 into position 6.

A third hydraulic motor 120 means is mounted on a transporter 34 and has a drive shaft 122 in communication with two lateral drive sprockets 124 and 126 having chain drives 128 and 130 mounted thereon in communication with respective idler sprockets 132 and 134 on idler shaft 133. On each respective chain drive 128 and 130 there are two lateral engagement members 136, 138 and 136A, 138A positioned in 180 degrees relationship to each other. The lateral engagement members 136 and 138 on chain drives 128 and 130 are designed to engage or contact the inner wall of depending flange 82 or 84 on parking platform 32 to slidably move or remove parking platform 32 or parking platform 32 and vehicle 25 from positions 3 and 7.

Positioned at each corner of transporter 34 are four additional hydraulic motors 140, 142, 144, and 146 each having a retractable coupling 150, 152, 154, and 156.

Figure 7:
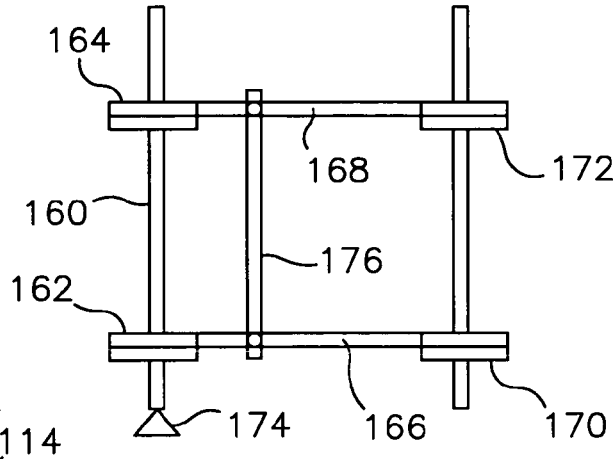
FIG. 7 is a planar top view of the parking platform mechanicals.

The parking platform mechanicals to slidably move or remove parking platform 32 or parking platform 32 and vehicle 25 from the corner positions 2, 4, 6, and 8 is the same for each corner and one such parking platform mechanical is illustrated in FIG. 7. The parking platform mechanicals consist of a drive shaft 160 upon which two sprockets 162 and 164 are mounted and about which a two chain drive 166 and 168 are positioned in communication with two additional idler sprockets 170 and 172 mounted proximate the periphery of the parking facility. Each drive shaft 160 has a coupling member 174 complimentary with the retractable coupling member 150, 152, 154, or 156 on the hydraulic motors 140, 142, 144, or 146. Mounted on the parallel chain drives 166 and 168 is a lateral engagement bar 176.

In operation, the hydraulic motor 100 and chain drives 112 and 114 at the first end of transporter 34 would engage the parking platform 32 or parking platform 32 and vehicle 25 and slidably move it to position 1. Hydraulic motor 140 and retractable coupling 150 would engage coupling member 174 on the drive shaft 160 with lateral engagement bar 176 positioned to slide within channel 86 or 87 on the underside of the parking platform 32. Hydraulic motor 140 in cooperation with retractable coupling 150 and coupling member 174 would rotate drive shaft 160 and sprockets 162 and 164 with lateral engagement bar 176 contacting the inner flange surface of parking platform 32 and move the parking platform 32 or parking platform 32 and vehicle 25 laterally into position 2. The reverse would occur when one wished to remove parking platform 32 or parking platform 32 and vehicle 25 from parking position 2. Identical assemblies and operation would occur with respect to parking positions 4, 6, and 8.

It will be noted that in the operation of the vertical lift parking facility as described herein, the vehicles being elevated would be positioned in parking spaces 2, 4, 6, and 8 initially before parking spaces 1 and 5 were filled so as to allow for the temporary use of these two parking spaces to maneuver cars.

The facility is shown operating with one transporter 34 in the transport elevator shaft 30. However, since the entire facility is to be computer operated, it would be possible to locate two transporters 34 in the transporter elevator shaft 30, each with its own elevator lift mechanism, with the upper tier of the vertical lift parking facility having an extended shaft for the temporary location of the upper transporter and the lower tier of the vertical lift parking facility having an extended shaft for the temporary location of the lower transporter. In this regard, depending upon the size of the facility, one transporter could be parking or retrieving vehicles at a lower level and a second transporter might be rearranging vehicles at the upper levels and when not in use the upper transporter elevator could be sent upwardly to remain in a stable but unused position above the upper level of the vehicle parking facility or the lower transporter elevator could be sent downwardly to remain in a stable but unused position below the lower level of the vehicle parking facility.

Two transporter elevator mechanisms can be connected together, using only one elevator lift mechanism, such that the upper unit can be used for the movement of parking platforms containing vehicles and a lower unit can be used for positioning and repositioning of empty parking platforms. This method would reduce the number of trips up and down the transporter elevator shaft to store and retrieve empty platforms thereby reducing the amount of time required for parking vehicles.

The transporter lift 34 contains a series of hydraulic motors and valves connected to a small hydraulic pump 200 and a series of hydraulic accumulators 202, which are controlled by a computer system. The system is designed so that whenever a parking platform 32 is being moved by the hydraulic motors on the transporter 34, the computer system regulates the amount of energy being delivered to the motor, which is greater than the amount of energy that the hydraulic pump is capable of providing, and supervises the recharging of the accumulator system. In this method the energy supplied to the transporter 34 is approximately ⅙ of the energy required to move a fully loaded parking platform 32 therefore the hydraulic pump contained on the transporter elevator is ⅙ the size that would otherwise be required.

An additional feature of this hydraulic system is that the accumulators store enough energy to complete all required movements on any level, even if the main power is lost, which insures that the parking platforms 32 are not left in an intermediary position which could be dangerous or cause damage to vehicles.

The vehicle parking facility of the present invention as disclosed herein, discloses a multi-level, vertical parking facility that can accommodate 8 cars per level and the number of levels being limited by the strength of the framing mechanism constructed. It will be recognized that these vertical parking facilities 10 can be erected in modules, immediate adjacent each other such that each has its own ingress and egress and transporter elevator means associated therewith.

The design construction and operation of the facility provides for the total use of the ground foot print upon which the structure is constructed so as to better utilize the land and offer a greater return on investment, particularly in areas where real estate is expensive.

While the present invention has been disclosed with regard to the exemplary embodiment thereof, it will be recognized by those of ordinary skill in the trade that modifications to the invention can and may be made without departing from the spirit and scope of the invention. Therefore it is manifestly intended that the scope of the invention be limited only by the scope of the claims and the equivalents thereto.

I claim:

1. An automated, multi-level vehicle parking assembly comprising:

a frame defining a multi-level parking facility having an elevator shaft and elevator means in communication with each level of said multi-level parking facility, said frame having a ingress and egress means for a vehicle;

a plurality of parking positions on said frame on each said level disposed about said elevator shaft for positioning said vehicle forwardly, rearwardly, laterally, forwardly laterally, and rearwardly laterally of said elevator shaft, said forwardly and rearwardly positions having lateral transfer means for said forwardly laterally and said rearwardly laterally movement;

a parking platform associated with each said parking position, said parking platform slidably removable from said parking position, said parking platform for receipt and transfer of said vehicle from said ingress means to said parking position and from said parking position to said egress means;

a transport means positioned in said elevator shaft, said transport means in selective communication with each level of said multi-level parking facility, said transport means having a plurality of motors and transport engagement members mounted thereon to engage said parking platform from said parking position and transport said parking platform to said ingress means for receipt of said vehicle and engaging said parking platform and said vehicle from said ingress means and transfer to said parking position and to engage said parking platform and said vehicle from said parking position and transfer to said egress means, said plurality of motors in communication with a power source, said transport means comprising:

a transport frame member having a first end and a second end for receipt on said frame member of said parking platform, said transport frame member and said parking platform cooperable to allow ingress of a vehicle onto said parking platform and transport frame member and egress of a vehicle from said transport frame member and said parking platform, said transport frame member having mounted thereon a first and second hydraulic motor means disposed on opposing ends of said transport frame member, said first and second hydraulic motor means in communication with a hydraulic fluid source, said first and second motor means in further communication with a pair of drive sprocket means, each of said drive sprocket means in communication with an idler sprocket means, there being disposed about said drive sprocket means and said idler sprocket means a chain drive in counter-rotational relationship, each of said chain drives having a plurality of upstanding fingers engagable with said engagement member on said underside of said parking platform, said idler sprockets extending and said chain drive extending beyond said first end and said second end of said transport frame member so as to transport said parking platform forwardly and rewardly;

a third lateral hydraulic motor means mounted on said frame member in communication with a source of hydraulic fluid, said third lateral hydraulic motor means having a shaft member in communication with a third pair of drive sprockets, said third pair of drive sprockets in communication with a third pair of idler sprockets by means of a third pair of chain drives, each of said chain drives having a pair of engagement stops mounted in 180 degree relationship thereon, said engagement stops cooperable with said longitudinal L-shaped flanges of said parking platform for lateral movement of said parking platform;

a fourth hydraulic motor means comprising four hydraulic motors in communication with a source of hydraulic fluid, said four hydraulic motors are mounted on said transport frame, one each, in each corner of said transport frame facing forwardly and rewardly, each of said motors having a rotatable, extensible, retractable coupling means cooperable with said lateral transfer means mounted on said frame defining said multi-level parking facility, said lateral transfer means comprising a pair of shaft mounted drive sprockets mounted in alignment with each of said fourth hydraulic motor means and having a complimentary coupling cooperable with said rotatable, extensible, retractable coupling of said fourth hydraulic motor means for rotation of said shaft and drive sprocket, said drive sprockets in communication with a pair of shaft mounted idler sprockets mounted proximate the periphery of said frame defining said multi-level parking facility and in communication with said drive sprockets by means of chain drives, said chain drives having mounted thereon a lateral engaging transfer bar for engagement with said parking platform to slide said parking platform laterally from said rearward or forward parking positions.

2. The automated multi-level vehicle parking assembly in accordance with claim 1 wherein said parking platform is dimensioned to receive a vehicle, said parking platform having longitudinal L-shaped inwardly facing flanges there being mounted on the lower surface of said L-shaped flanges a plurality of slide members cooperable with said frame for sliding said parking platform, there being formed on the underside of said parking platform a plurality of engagement members in parallel, spaced apart relationship.

3. An automated, multi-level storage facility comprising:

a frame defining a multi-level storage facility having an elevator shaft and elevator means in communication with each level of said multi-level storage facility, said frame having a ingress and egress means for stored material;

a plurality of storage positions on said frame on each said level disposed about said elevator shaft for positioning said stored material forwardly, rearwardly, laterally, forwardly laterally, and rearwardly laterally of said elevator shaft, said forwardly and rearwardly positions having lateral transfer means for said forwardly laterally and said rearwardly laterally movement;

a parking platform associated with each said storage position, said parking platform slidably removable from said storage position, said parking platform for receipt and transfer of said stored material from said ingress means to said storage position and from said storage position to said egress means;

a transport means positioned in said elevator shaft, said transport means in selective communication with each level of said multi-level storage facility, said transport means having a plurality of motors and transport engagement members mounted thereon to engage said parking platform from said storage position and transport said parking platform to said ingress means for receipt of said stored material and engaging said parking platform and said stored material from said ingress means and transfer to said storage position and to engage said parking platform and said stored material from said storage position and transfer to said egress means, said plurality of motors in communication with a power source, said transport means comprising:

a transport frame member having a first end and a second end for receipt on said frame member of said parking platform, said transport frame member and said parking platform cooperable to allow ingress of stored material onto said parking platform and transport frame member and egress of stored material from said transport frame member and said parking platform, said transport frame member having mounted thereon a first and second hydraulic motor means disposed on opposing ends of said transport frame member, said first and second hydraulic motor means in communication with a hydraulic fluid source, said first and second motor means in further communication with a pair of drive sprocket means, each of said drive sprocket means in communication with an idler sprocket means, there being disposed about said drive sprocket means and said idler sprocket means a chain drive in counter-rotational relationship, each of said chain drives having a plurality of upstanding fingers engagable with said engagement member on said underside of said parking platform, said idler sprockets extending and said chain drive extending beyond said first end and said second end of said transport frame member so as to transport said parking platform forwardly and rewardly;

a third lateral hydraulic motor means mounted on said frame member in communication with a source of hydraulic fluid, said third lateral hydraulic motor means having a shaft member in communication with a third pair of drive sprockets, said third pair of drive sprockets in communication with a third pair of idler sprockets by means of a third pair of chain drives, each of said chain drives having a pair of engagement stops mounted in 180 degree relationship thereon, said engagement stops cooperable with said longitudinal L-shaped flanges of said parking platform for lateral movement of said parking platform;

a fourth hydraulic motor means comprising four hydraulic motors in communication with a source of hydraulic fluid, said four hydraulic motors are mounted on said transport frame, one each, in each corner of said transport frame facing forwardly and rewardly, each of said motors having a rotatable, extensible, retractable coupling means cooperable with said lateral transfer means mounted on said frame defining said multi-level parking facility, said lateral transfer means comprising a pair of shaft mounted drive sprockets mounted in alignment with each of said fourth hydraulic motor means and having a complimentary coupling cooperable with said rotatable, extensible, retractable coupling of said fourth hydraulic motor means for rotation of said shaft and drive sp rocket, said drive sprockets in communication with a pair of shaft mounted idler sprockets mounted proximate the periphery of said frame defining said multi-level parking facility and in communication with said drive sprockets by means of chain drives, said chain drives having mounted thereon a lateral engaging transfer bar for engagement with said parking platform to slide said parking platform laterally from said rearward or forward parking positions.

4. The automated multi-level storage facility in accordance with claim 3 wherein said parking platform is dimensioned to receive stored material, said parking platform having longitudinal L-shaped inwardly facing flanges there being mounted on the lower surface of said L-shaped flanges a plurality of slide members cooperable with said frame for sliding said parking platform, there being formed on the underside of said parking platform a plurality of engagement members in parallel, spaced apart relationship.

* * * * *